US006639486B2

(12) United States Patent
Buck

(10) Patent No.: US 6,639,486 B2
(45) Date of Patent: Oct. 28, 2003

(54) TRANSITION FROM MICROSTRIP TO WAVEGUIDE

(75) Inventor: Christopher M. Buck, Stockport (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 53 days.

(21) Appl. No.: 10/104,928

(22) Filed: Mar. 22, 2002

(65) Prior Publication Data

US 2002/0163397 A1 Nov. 7, 2002

(30) Foreign Application Priority Data

May 4, 2001 (GB) ..... 0108696

(51) Int. Cl.[7] ..... H01P 5/107
(52) U.S. Cl. ..... 333/26; 333/34
(58) Field of Search ..... 333/26, 34, 33, 333/24 R, 24.1

(56) References Cited

U.S. PATENT DOCUMENTS 4,725,793 A * 2/1988 Igarashi ..... 333/26
4,754,239 A 6/1988 Sedivec ..... 333/26
4,980,636 A * 12/1990 Romanofsky et al. ..... 324/754
6,265,950 B1 * 7/2001 Schmidt et al. ..... 333/26

FOREIGN PATENT DOCUMENTS

WO WO9811621 3/1998 ..... H01P/5/107

* cited by examiner

*Primary Examiner*—Robert Pascal
*Assistant Examiner*—Dean Takaoka
(74) *Attorney, Agent, or Firm*—Michael E. Belk

(57) ABSTRACT

A transition from microstrip to waveguide comprises a rectangular waveguide and a microstrip structure formed by a resilient substrate (24) having a stripline (26) on one surface and a ground plane (44) on an opposite surface, the conductors (26, 44) being interconnected by viaholes. The substrate (24) is disposed between the side walls (36) and the floor (22) of the waveguide with the ground plane contacting the floor. The stripline extends from one end of the waveguide along a portion of its length. A tapered ridge (38) depends from the ceiling (34) of the waveguide and extends from the other end of the waveguide. A terminal end (40) of the ridge contacts a terminal portion of the stripline under mechanical pressure. The ridge (38) may have a choice of profiles such as triangular, half cosine and half cosine with a semicircular cut-out in the upright edge.

11 Claims, 2 Drawing Sheets

TRANSITION FROM MICROSTRIP TO WAVEGUIDE

Figure 1:
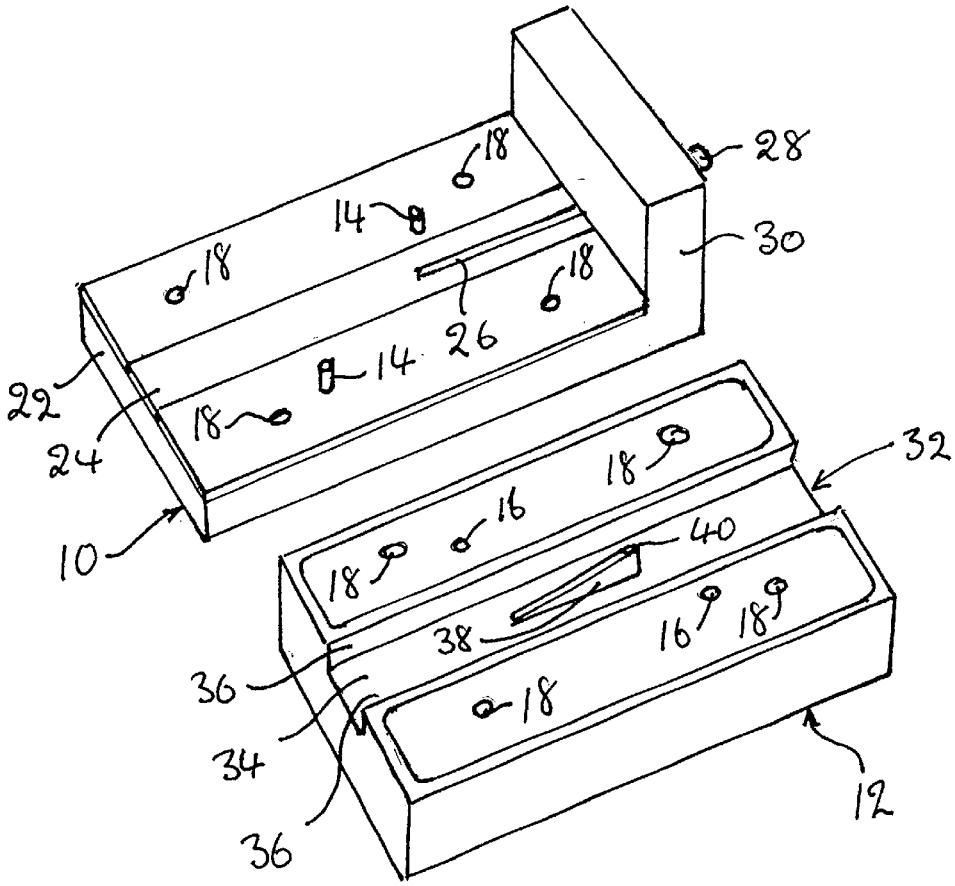

The present invention relates to a transition from microstrip to waveguide. A particular, but not exclusive, application for such a transition is to enable energy in RF circuits fabricated in microstrip to be coupled to an antenna port generally formed by waveguide.

U.S. Pat. No. 4,754,239 discloses a waveguide to stripline transition. A stripline comprises two strip conductors, one on each side of a dielectric sheet. The transition described and shown comprises a length of stripline secured to the underside of the floor of an overlapping end of a length of rectangular waveguide. Within the waveguide and mounted on the ceiling, symmetrically of the longitudinal plane of symmetry, is a substantially right angled triangular ridge having a terminal end portion connected to one of the stripline conductors. The transition is tuned to provide an optimum impedance and voltage standing wave ratio (VSWR) by moving a reflecting panel behind the wedge along the waveguide from an open end.

WO98/11621 discloses a transition from a waveguide to a strip transmission line which is fabricated as a one-piece component. A web located within and symmetrically of the longitudinal plane of symmetry of the waveguide reduces the cross section of the waveguide in a direction towards the strip transmission line to which it is connected electrically. The cross-section of the web also tapers symmetrically towards the connection to the strip transmission line. The longitudinal profile of the web may take several forms including stepped, straight, convex, concave and double taper.

In both these prior transitions, there is a risk of premature hard metal to metal contact which will tend inhibit reliable contact between the tapered ridge or web and the stripline conductor.

An object of the present invention is to improve the electrical contact in waveguide to microstrip transitions.

According to a first aspect of the present invention there is provided a transition from microstrip to waveguide, comprising a rectangular waveguide composed of a floor separated from, but electrically connected to, side walls and a ceiling, a microstrip structure including a resilient substrate coextensive with the floor and separating the side walls from the floor, and an electrical contact depending from the ceiling and contacting the microstrip structure.

The first aspect of the present invention provides a transition from microstrip to waveguide, comprising a rectangular waveguide comprising a ceiling integrally formed with side walls and a separate floor and a microstrip structure formed by a resilient substrate having a stripline conductor on one surface and a ground plane conductor on an opposite surface, wherein the substrate is disposed between the sidewalls and the floor with the planar conductor contacting the floor, the stripline conductor extends along the longitudinal plane of symmetry for a portion of the length of the waveguide from one end thereof, means are provided for electrically connecting the floor to the sidewalls, and a tapered ridge depends from the ceiling and extends along the longitudinal plane of symmetry of the ceiling in a direction from the other end thereof, a terminal end of the ridge contacting a terminal portion of the stripline conductor.

According to a second aspect of the present invention there is provided a combination of a microstrip RF circuit, a waveguide for connection to an antenna and a transition from microstrip to waveguide, the transition comprising a transition made in accordance with the first aspect of the present invention.

As the microstrip structure includes a resilient substrate, the side walls bear onto a relatively soft surface which prevents premature contact between hard metal surfaces which would be the case if the substrate was dimensioned to fit within the area bounded by the side walls. As a result a good electrical connection between the depending electrical contact and the microstrip structure can be effected under mechanical pressure.

Figure 4:
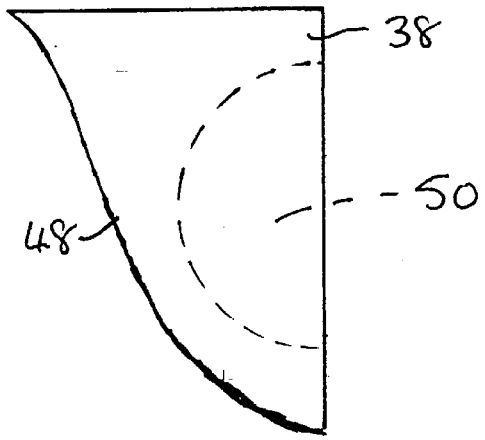
Figure 2:
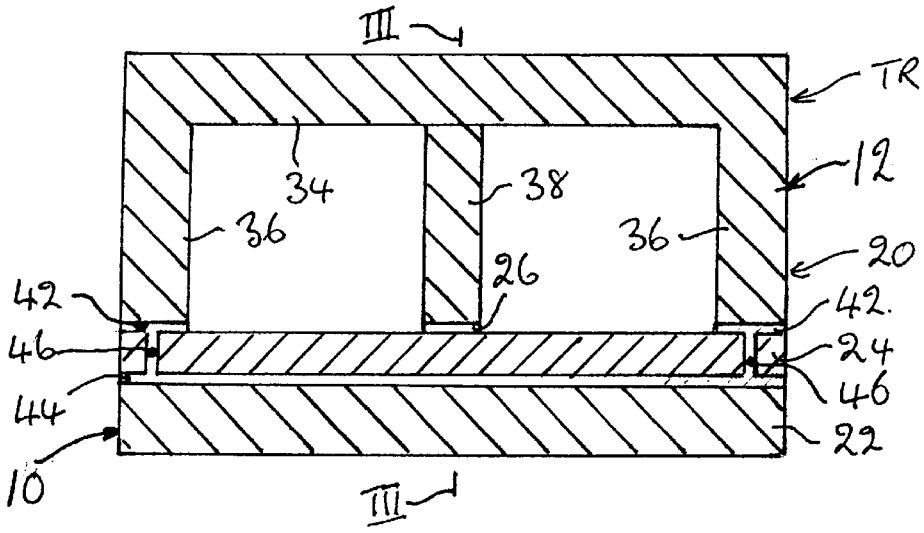
Figure 3:
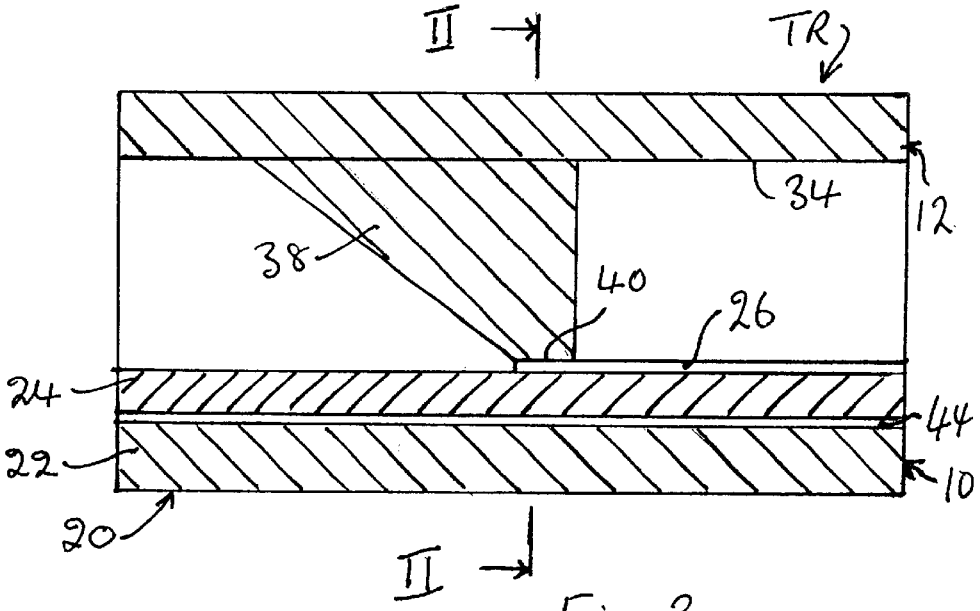
Figure 5:
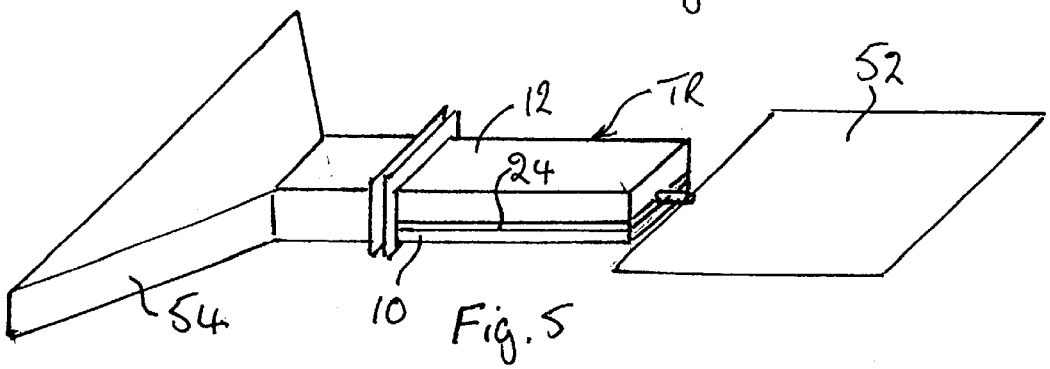

The present invention will now be described, by way of example, with reference to the accompanying drawings, wherein:

FIG. 1 is a perspective view of a test jig comprising a transition made in accordance with the present invention;

FIG. 2 is a diagrammatic cross sectional view on the line II—II in FIG. 3, FIG. 3 is a diagrammatic cross sectional view on the line III—III in FIG. 2, FIG. 4 is a diagram of a tapered ridge having a half-cosine profile and optionally a semi-circular cut-out in the right angled edge, and FIG. 5 is a diagram of the transition made in accordance with the present invention coupling a horn antenna to a RF circuit board.

In the drawings the same reference numerals have been used to indicate corresponding features.

Referring to FIG. 1, the test jig comprises a lower part 10 and an upper part 12. The lower part has alignment pins 14 which are received in apertures 16 when the upper part 12 is placed on the lower part 10. The parts are held together by screws (not shown) which pass through apertures 18 to define a length of waveguide 20.

The lower part 10 comprises the floor 22 of the waveguide 20 onto which a resilient dielectric substrate 24 is mounted. A microstrip track 26 extends along the longitudinal axis of symmetry of the floor 22 for part of its length. For testing purposes the track connected to a coaxial socket 28 mounted on an upstanding wall 30 at one end of the lower part 10. In actual practice, the upstanding wall 30 is omitted and the microstrip track 36 is connected to another microstrip circuit such as a low noise amplifier.

The upper part 12 has a rectilinear channel 32 extending symmetrically of the longitudinal plane of symmetry. The channel 32 comprises the ceiling 34 and the sidewalls 36 of the waveguide 20. A tapered ridge 38 having the profile of a right angled triangle as shown or another suitable profile such as half cosine is secured to, or formed integrally with, the ceiling 34 so as to depend towards and contact the end of the microstrip track 26 when the jig is assembled. The portions of the upper part 12 lying outwards of the sidewalls 36 are rebated so that when the jig is assembled, the flattened apex 40 of the ridge 38 bears on the microstrip track 26 and the pressure is absorbed by the resilient substrate 24. With such an arrangement good electrical contact between the tapered ridge 38 and the microstrip track 26 is not inhibited by a premature good electrical contact between the hard metal surfaces of the parts 10, 12.

Referring now to FIGS. 2 and 3, more details will be given of the construction of the transition made in accordance with the present invention. The tapered ridge 38 is placed in the E-plane of the waveguide 20 and depends from the ceiling 34 in the middle of the long (A) dimension down to the microstrip track 26 on the resilient substrate 24 which is disposed on the floor 22 of the waveguide. As shown in the drawings, the waveguide 20 is split lengthwise and the sidewalls 36 rest on tracks 42 provided on the substrate 24. A ground plane 44 is provided on the underside of the substrate 24 and provides an electrical contact with the floor 22. Metallised viaholes 46 provide a means for effecting a good RF contact from the top to the bottom of the substrate 24. The substrate 24 is pressed down towards the floor 22 of the waveguide by pressure applied mechanically to the sidewalls 36 and the ridge 38 and insodoing urges the ridge 38 into mechanical and electrical contact with the microstrip track 26. The size of the waveguide 20 is selected depending on its frequency of operation and in order to operate in frequency bands over the range 23 GHz to 42.5 GHz, this frequency range can be divided into three portions with the middle portion of 26.5 GHz to 40 GHz being covered by using WG22 (WR28) waveguide. A lower portion between 23 GHz and 26.5 GHz can be covered using WG21 waveguide and an upper portion between 40 GHz and 42.5 GHz can be covered using WG23 waveguide.

The substrate 24 may be of any suitable dielectric material, such as 10 mil softboard with a dielectric constant 2.2. In the case of the jig shown in FIG. 1 the substrate with the microstrip track was 10 mil Taconic TLY5 0100CH/CH and the track was 0.75 mm wide half ounce (17 $\mu$m thick) copper with through-hole-plating copper (20 to 30 $\mu$m thick) and NiAu plating.

Simulations based on waveguide size WR28 and using triangular ridges having lengths of 10 mm, 15 mm and 20 mm, and a width corresponding to that of the microstrip track 26, namely 0.75 mm, has shown that broadband performance is achieved for 15 mm and 20 mm lengths and increases with ridge length, with return losses of greater than 13 db from 25 GHz to 40 GHz for ridge lengths of 20 mm.

Simulations also showed that the microstrip track 26 should not extend too far beneath the flattened apex 40 of the ridge and an overlap of 0.1 mm was considered not only acceptable from a performance point of view but also achievable in high volume manufacture.

Generally, it was found that making the width of the ridge 38 equal to that of the microstrip track 26, namely 0.75 mm, gave a slightly better performance than making it smaller, 0.5 mm, or larger, 1.00 mm.

The ridge shape may be other than triangular, for example FIG. 4 a half cosine profile 48 and a half cosine profile 48 with a semicircular cut-out 50 in the right angled edge. Simulations using these profiles showed that half cosine with a semicircular cut-out gave a greater than 20 dB return loss from 25 GHz to 32 GHz which was better than triangular and half cosine. However from a manufacturing point-of-view, a half cosine profile is regarded as the best compromise.

In manufacturing the transition NiAu plating was found to offer an approximate 0.8 dB reduction in insertion loss over phoschromating.

FIG. 5 illustrates the use of the transition TR made in accordance with the present invention in coupling a RF board 52 to a horn antenna 54 for use in an application such as two-way mm-wave communication systems including point-to-point and point-to-multipoint applications operating in frequency bands over the range 23 GHz to 42.5 GHz.

In the present specification and claims the word "a" or "an" preceding an element does not exclude the presence of a plurality of such elements. Further, the word "comprising" does not exclude the presence of other elements or steps that those listed.

From reading the present disclosure, other modifications will be apparent to persons skilled in the art. Such modifications may involve other features which are already known in the design, manufacture and use of waveguide to microstrip transitions and component parts therefor and which may be used instead of or in addition to features already described herein.

What is claimed is:

1. A transition from microstrip to waveguide, comprising a rectangular waveguide composed of a floor separated from, but electrically connected to, side walls and a ceiling, a microstrip structure including a resilient substrate coextensive with the floor and separating the side walls from the floor, and an electrical contact depending from the ceiling and contacting the microstrip structure.

2. A transition as claimed in claim 1, characterised in that the electrical contact comprises a ridge attached to the ceiling and extending along the longitudinal plane of symmetry.

3. A transition as claimed in claim 2, characterised by means for applying mechanical pressure for urging the ridge to effect electrical contact with the microstrip structure.

4. A transition as claimed in claim 2, characterised in that the ridge has a profile of a substantially right angled triangle, having a substantially straight tapering edge.

5. A transition as claimed in claim 2, characterised in that the ridge has a generally triangular profile and a half cosine tapering edge.

6. A transition as claimed in claim 2, characterised in that the ridge has a profile comprising a substantially half cosine tapering edge and an upright edge having a curvilinear cut-out.

7. A transition as claimed in claim 2, characterised in that the ridge has substantially parallel sides.

8. A transition as claimed in claim 1, characterised in that the waveguide is plated with NiAu.

9. The combination of a microstrip RF circuit, a waveguide for connection to an antenna and a transition from microstrip to waveguide, the transition comprising a transition as claimed in claim 1.

10. A transition from microstrip to waveguide, comprising a rectangular waveguide comprising a ceiling integrally formed with side walls and a separate floor and a microstrip structure formed by a resilient substrate having a stripline conductor on one surface and a ground plane conductor on an opposite surface, wherein the substrate is disposed between the sidewalls and the floor with the ground plane conductor contacting the floor, the stripline conductor extends along the longitudinal plane of symmetry for a portion of the length of the waveguide from one end thereof, means are provided for electrically connecting the floor to the sidewalls, and a tapered ridge depends from the ceiling and extends along the longitudinal plane of symmetry of the ceiling in a direction from the other end thereof, a terminal end of the ridge contacting a terminal portion of the stripline conductor.

11. A transition as claimed in claim 10, characterised in that the width of the ridge corresponds substantially to the width of the microstrip track.

* * * * *